United States Patent [19]

Lippmaa et al.

[11] 4,258,906

[45] Mar. 31, 1981

[54] DEVICE FOR GRADIENT HEATING OF WIRE

[76] Inventors: Endel T. Lippmaa, ulitsa Sybra, 14, kv. 2; Vambola I. Roose, ulitsa Ryannaku, 3, kv. 4, both of, Tallin; Tynu K. Karu, Okhtu tee, 9, Keila, all of U.S.S.R.

[21] Appl. No.: 11,547

[22] Filed: Feb. 12, 1979

[51] Int. Cl.[3] ..... C21D 1/74; C21D 9/52; F27B 5/04

[52] U.S. Cl. ..... 266/250; 13/31 R; 266/87; 266/260; 432/81; 432/205

[58] Field of Search ..... 266/249, 250, 260, 87, 266/90, 99; 148/1, 4, 13, 13.1, 128, 129; 165/80, 80 E, 80 A, 146, 32, 75; 13/31 R, 20; 432/81, 202, 205, 231

[56] References Cited

U.S. PATENT DOCUMENTS

| | | | |
|---|---|---|---|
| 2,555,310 | 6/1951 | Beltz | 266/260 |
| 2,843,514 | 7/1958 | Kunz, Jr. | 148/13 R |
| 3,243,493 | 3/1966 | Bunshah et al. | 13/31 |

FOREIGN PATENT DOCUMENTS

| | | | |
|---|---|---|---|
| 978069 | 11/1975 | Canada | 148/13 R |

*Primary Examiner*—L. Dewayne Rutledge
*Assistant Examiner*—Peter K. Skiff
*Attorney, Agent, or Firm*—Lackenbach, Lilling & Siegel

[57] ABSTRACT

A device for gradient heating of a wire includes a vacuum chamber with a thermostatically regulated base and a means for producing a temperature gradient arranged thereinside. The means for producing a temperature gradient is designed in the form of a metallic cylinder with one end thereof having an electric heater and the other end being attached to the thermostatically regulated base of the vacuum chamber, serving as a cooler. The surface of the metallic cylinder is furnished with transverse grooves intended for locating therein a wire being heated and interconnected by a longitudinal groove intended for passing the wire from one transverse groove into the other.

5 Claims, 4 Drawing Figures

DEVICE FOR GRADIENT HEATING OF WIRE

FIELD OF THE INVENTION

The present invention relates generally to the fabrication of wire-wound resistors, and more specifically to devices for gradient heating of a wire.

The invention may find application whenever it is required to expeditiously determine the accurate parameters of conditions of thermal treatment for a variety of wires with a view to producing a wire featuring preassigned properties.

The present invention can be most advantageously utilized for expeditious determination of accurate parameters of conditions of thermal treatment of a resistive wire intended for use in the fabrication of wire-wound resistors with the object of providing a preassigned value of its resistance temperature coefficient.

BACKGROUND OF THE INVENTION

As is known, the resistance temperature coefficient of a resistive wire represents a function of its resistance variation with temperature variation, i.e. it reflects the stability of a resistance value with time for a specific resistive wire. The resistance value stability of a resistive wire is governed by the physical-chemical processes occurring in its material. One of the most important factors affecting these processes is the kind of thermal treatment to which the resistive wire is subjected. The properly chosen conditions of its thermal treatment tend to stabilize physical-chemical processes taking place in the wire. This provides a resistive wire with a small value of the resistance coefficient. Optimum thermal treatment conditions are determined by means of deriving a function of the resistance temperature coefficient versus variation of thermal treatment conditions. In practice, this function or characteristic is derived by thermally treating resistive wire specimens made from a single-smelting alloy under different conditions. The degree of accuracy of the function or characteristic obtained is largely dependent on the number of the tests performed as well as on the degree of the accuracy of setting of the temperature of thermal treatment. As experience shows, the resistive wire made from the same alloy but of a different smelting exhibits a different function or characteristic of the resistance temperature coefficient versus variation of thermal treatment conditions so that in order to derive this function or characteristic it is necessary to perform the tests again.

At present, to obtain function or characteristic of the resistance temperature coefficient of a particular resistive wire versus variation of conditions of its thermal treatment, known laboratory vacuum furnaces are utilized which are similar in construction to industrial furnaces employed for thermal treatment of metals. Resistive wire specimens are thermally treated in these furnaces under different temperature conditions within a temperature range in which the achievement of optimum thermal treatment conditions is expected.

The dependence of the resistance temperature coefficient on the variation of thermal treatment conditions is derived from the test results, and according to the dependence or relationship obtained optimum conditions are chosen.

The construction of vacuum furnaces intended for thermal treatment of metals does not enable thermal treatment of several resistive wire specimens to be performed simultaneously under different conditions.

From the foregoing it follows that the determination of optimum thermal treatment conditions by means of such furnaces is an extremely labour-consuming procedure.

Furthermore, the data thus obtained are not reliable inasmuch as the construction of the furnaces does not afford of a sufficient extent accurate setting to the desired temperature conditions.

The above stated essential disadvantages inherent in vacuum furnaces for thermal treatment of metals are partially eliminated by a gradient sublimator for crystallization (see a U.S. "Journal of Crystal Growth", 22, 1974, pp. 295–297), which can be employed to determine thermal treatment conditions for a specific resistive wire and, therefore, has been taken as a prior art prototype of the present invention. The device under consideration comprises a means for producing a temperature gradient in a crystal being examined, designed in the form of a hollow metallic cylinder with one end thereof carrying an electric heater and the other end carrying a cooler. Within the cylinder there is arranged a glass vacuum chamber having its base connected to a vacuum pump, and intended to contain therein the crystal being examined.

Upon turning on the heater and the cooler a temperature gradient is developed in the crystal under study. The temperature gradient in the crystal is caused by a radiant thermal energy being emanated by the inner surface of the hollow cylinder. Instead of the crystal under study, inside the vacuum chamber, there may be located a resistive wire specimen in which a temperature gradient also arises.

While the above device can provide simultaneous heating of a resistive wire specimen up to different temperatures along the length thereof, the linear character of lengthwise temperature gradient distribution is absent. This is accounted for by the fact that each portion over the length of the resistive wire specimen will be heated by the radiant thermal energy being emanated by various portions of the inner surface of the hollow cylinder. Moreover, the temperatures of the portions over the length of the specimen will not be stable with time, which is attributed to the influence of the environment on the means for producing a temperature gradient.

In view of the above, it becomes perfectly evident that with the prior art device in question it is impossible to find out a reliable dependence of the resistance temperature coefficient on the variation of thermal treatment temperatures. Hence, such a dependence does not allow one to ascertain optimum conditions under which the resistive wire is to be exposed to thermal treatment.

From the exemplary matter considered hereinabove it is obvious that the present state of the art does not include any special devices enabling expeditious and reliable determination of optimum resistive wire thermal treatment conditions.

SUMMARY OF THE INVENTION

The present invention is directed at minimizing or avoiding the foregoing disadvantages.

It is an object of the present invention to provide such a construction of a device for gradient heating of a wire which will ensure high accuracy of determination of thermal treatment conditions.

It is another object of the invention to provide such a construction of a device for gradient heating of a wire which will ensure a reduction in labour consumption involved in determination of thermal treatment conditions.

It is still another object of the invention to provide such a construction of a device for gradient heating of a wire which will feature high reliability in operation.

With these and other objects in view, there is provided a device for gradient heating of a wire comprising a vacuum chamber with a base and a means for producing a temperature gradient designed in the form of a metallic cylinder, a heater for heating one end of said cylinder and a cooler for cooling the other end thereof, wherein, according to the invention, the means for producing a temperature gradient is arranged within the vacuum chamber and the surface of the metallic cylinder is furnished with transverse grooves for locating therein the wire being heated, interconnected by a longitudinal groove for passing the wire from one transverse groove into the other, whereas the base of the vacuum chamber serves as a cooler and is made thermostatically regulated.

Such an arrangement permits one to attain a linear character of temperature variation in the metallic cylinder along its length. As a consequence, each turn of the resistive wire along the entire length thereof has a closely controlled temperature of heating. Knowing the exact temperature of heating of each turn of the resistive wire and having measured its resistance coefficient, it is possible to obtain a reliable dependence of the resistance temperature coefficient on the temperature variation of thermal treatment. The optimum conditions of thermal treatment are determined from the reliable function characteristic or dependence obtained.

It is of advantage that the transverse grooves for locating therein the wire being heated should be made along the directrix of the metallic cylinder.

Such an arrangement enables one to place each turn of the resistive wire along the entire length thereof exactly within the isothermal zone.

It is also of advantage that the transverse grooves have a wedge-shaped form.

The wedge-shaped grooves ensure rigid fixing of resistive wires of various diameters.

It is of advantage that the longitudinal groove has a depth exceeding that of the transverse grooves.

This facilitates and quickens the process of breaking up a specimen of the resistive wire into sections after the heating procedure has been completed.

The aforesaid and other objects as well as advantages of the present invention will become more readily apparent fron the ensuing detailed description of embodiments thereof with reference being made to the accompanying drawings, in which:

DETAILED DESCRIPTION OF THE INVENTION

Figure 1:
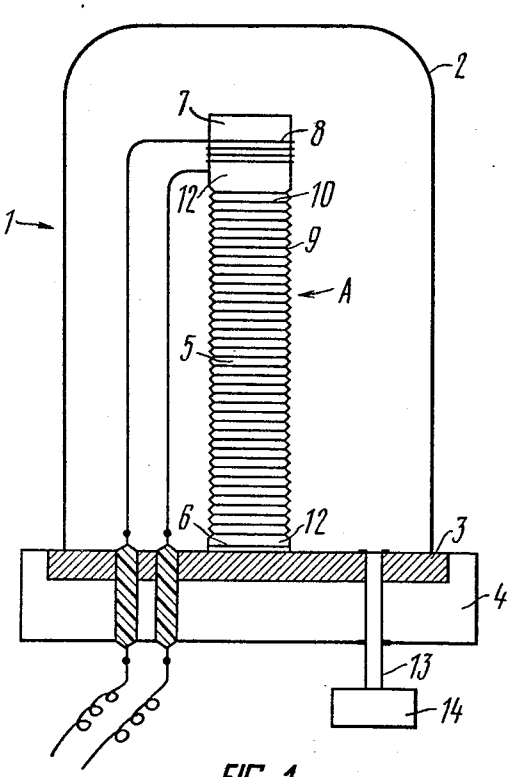
FIG. 1 illustrates a side view of a device for gradient heating of a wire according to the invention, with a section through the base of the vacuum chamber.

A device for gradient heating of a wire includes a vacuum chamber 1 (FIG. 1) including a hood 2 and a solid metallic base 3 disposed inside a thermostat 4. Within the vacuum chamber 1 there is arranged a metallic cylinder 5 attached to the base 3 thereof at its end 6. On the other end 7 of the metallic cylinder 5 there is mounted an electric heater 8. The base 3 serves as a cooler. The metallic cylinder 5, the heater 8 and the base 3 form a means for producing a temperature gradient. The surface of the metallic cylinder 5 has transverse grooves 9 (FIG. 2) embracing it along the directrix. The grooves 9 are intended for locating therein a resistive wire 10 being heated and are wedge shaped. The wedge shape of the grooves 9 enable one to locate therein the resistive wire 10 of various diameters and to fix it reliably against possible lateral displacements. To pass the resistive wire 10 from one groove 9 into the other, there is provided a longitudinal groove 11 interconnecting all the grooves 9. The longitudinal groove 11 (FIG. 3) has a larger depth than that of the grooves 9. This facilitates breaking up the resistive wire into sections after its thermal treatment, which will be disclosed in more detail hereinbelow.

Adjacent to the last grooves 9 (FIG. 1) on the metallic cylinder 5 there are fixed thermocouples 12 enabling high-accuracy measurements of the temperature differential in the area of the metallic cylinder 5 occupied by the grooves 9. The vacuum chamber 1 is connected to a vacuum pump 14 via a pipeline 13.

Figure 4:
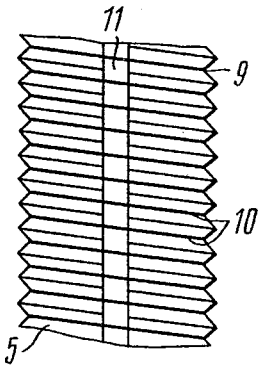
FIG. 4 illustrates an alternative embodiment of the cylinder of the means for producing a temperature gradient.

It should be noted that the transverse grooves 9 (FIG. 4) may be arranged on the surface of the metallic cylinder 5, for example, along a low pitch spiral. The resistive wire 10 will also be located in these grooves 9 spirally. To pass the resistive wire 10 from one groove 9 into the other, there is provided the longitudinal groove 11 interconnecting all the grooves 9.

Figure 2:
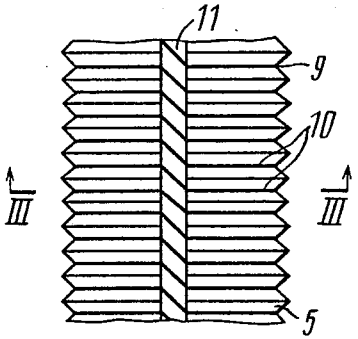
FIG. 2 is an enlarged view along the arrow A of FIG. 1.
Figure 3:
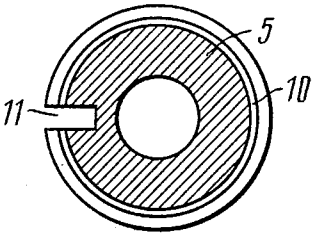
FIG. 3 is a sectional view taken on the line III—III of FIG. 2.

The device for gradient heating of a wire operates in the following fashion. A sample of the resistive wire 10 (FIG. 1) is wound into the grooves 9 passing it from one groove 9 into the other via the longitudinal groove 11, as can be seen in FIG. 2. The ends of the specimen of the resistive wire 10 that has been thus wound are secured by known means. The cylinder 5 (FIG. 1) with the specimen of the resistive wire 10 wound thereupon is placed inside the vacuum chamber 1 and, with the aid of the vacuum pump 14, vacuum is created therein, which permits one to exclude the thermal effect of the environment on the metallic cylinder 5. The electric heater 8 and the thermostatically regulated base 3 serving as a cooler provide in the cylinder 5 a closely controlled time-stable temperature gradient. The temperature range measured by the thermocouples 12 adjacent to the last grooves 9 and maintained within the limits of, for example, +400 to +500° C., is suitable for heat treatment of the resistive wire. This temperature gradient, as follows from well known thermodynamics laws, is logarithmic, that is linear in logarithmic coordinates. Within the specified sufficiently narrow temperature range this gradient can be considered constant, i.e. linear in linear coordinates. In other words, the device provides a linear character of temperature gradient distribution over the length of the cylinder 5. It is known that the plane perpendicular to a homogeneous heat flow is isothermal. Inasmuch as the transverse grooves 9 containing therein the turns of the resistive wire 10 being heated are located in the imaginary planes perpendicular to the cylinder 5, it means that each turn of the resistive wire 10 lies in the isothermic plane, that is subjected to isothermal heating along the entire length thereof. With a diameter of the cylinder 5 being equal, for example, to 5 cm, the length of a single turn being subjected to isothermal heating is about 15 cm., which is quite sufficient for subsequently measuring the resistance temperature coefficient with a high degree of accuracy. The number of the grooves 9 is equal to the required number of test temperature points sufficient to obtain a function or characteristic of the resistance temperature coefficient of the resistive wire versus variation of thermal treatment conditions thereof. In the actually manufactured device for gradient heating of a wire on the surface of the cylinder 5 there are made 100 grooves 9 spaced 1 mm apart. With the aforesaid temperature gradient equal to 100° C., the grooves 9 will be arranged exactly in the isothermal planes with a temperature difference between the adjacent grooves 9 being equal to 1° C. The temperatures of the last grooves 9 are measured with high accuracy by means of the thermocouples 12. The temperatures of the intermediate grooves 9 can be determined with high accuracy by means of linear interpolation. Thus, the accuracy of machining of the grooves 9 in the surface of the cylinder 5 determines the accuracy of the temperature of isothermal heating of the turns of the resistive wire 10 arranged in the grooves 9. The fabrication of the grooves 9 with an accuracy of, for example. 0.1 mm can be readily accomplished. Due to the wedge-shaped profile of the grooves 9, the turns of the resistive wire 10 are precision-fixed therein. This ensures the setting of a specific temperature of isothermal heating of the turns of the resistive wire 10 with an accuracy of 0.1° C. within the entire prescribed temperature range.

Subsequent to isothermal heating of the resistive wire 10, it is cooled together with the device down to an ambient temperature. The specimen of the resistive wire 10 is broken up into turns along the longitudinal groove 11, whereby there are produced 100 sections, each of which has been subjected to thermal treatment at a preset temperature. The sections are marked, and the temperature coefficient of each one is measured. Then the resistance temperature coefficient is plotted against the variation of thermal treatment conditions whereby the optimum conditions of thermal treatment which can provide a resistive wire having a minimum value of the resistance temperature coefficient are found.

In the case where the cylinder 5 of the present device incorporates the low pitch spiral grooves 9 (FIG. 4) formed on the surface thereof, the device will function primarily as outlined hereinabove. The difference consists in that in that case each turn of the resistive wire 10 will be disposed in several isothermal planes. However, with allowance made for the linear character of temperature gradient distribution over the length of the cylinder 5, the average temperature of isothermal heating of each turn is easily determined. The dependence of the resistance temperature coefficient on the variation of thermal treatment conditions obtained from these temperatures is also reliable and makes it possible to determined the optimum conditions of thermal treatment of a resistive wire.

From the consideration of the foregoing specific embodiments of the present invention it is readily apparent to those skilled in the art that all of the objects of the invention within the scope defined by the appended claims are achievable. However, it is also perfectly apparent that some minor modifications and variations can be introduced into the device for gradient heating of a wire without essentially departing from the spirit of the invention. All such modifications and variations are regarded to be well within the spirit and scope of the invention defined by the appended claims.

The present invention provides highly accurate determination of optimum conditions of thermal treatment of a resistive wire. Labour consumption involved in the determination of optimum thermal treatment conditions when employing the invention is significantly reduced scores of times. The construction of the device is simple and reliable in operation.

What is claimed is:

1. A device for gradient heating of a wire comprising:

a vacuum chamber with a thermostatically regulated base, means for producing a temperature gradient arranged within said vacuum chamber, said means for producing a temperature gradient incorporating a metallic cylinder, a heater for heating one end of said cylinder and a cooler for cooling the other end thereof, said cooler representing said thermostatically regulated base and the surface of said metallic cylinder being furnished with transverse grooves for locating therein a wire being heated and with a longitudinal groove for passing the wire being heated from one transverse groove into an other.

2. A device for gradient heating of a wire as defined in claim 1, wherein said transverse grooves are made along the directrix of the metallic cylinder.

3. A device for gradient heating of a wire as defined in claim 1, wherein the transverse grooves have the shape of a wedge in their cross section.

4. A device for gradient heating of a wire as defined in claim 2, wherein the transverse grooves have the shape of a wedge in their cross section.

5. A device for gradient heating of a wire as defined in claim 1, wherein said longitudinal groove has a depth larger than that of said transverse grooves.

* * * * *